US008796909B2

(12) United States Patent
Hasegawa et al.

(10) Patent No.: US 8,796,909 B2
(45) Date of Patent: Aug. 5, 2014

(54) IGNITER PLUG WITH COOLING FLUID AND METHOD OF MANUFACTURING IGNITER PLUG

(75) Inventors: Yukinobu Hasegawa, Aichi-ken (JP); Yasushi Sakakura, Aichi-ken (JP)

(73) Assignee: NGK Spark Plug Co., Ltd., Aichi (JP)

( * ) Notice: Subject to any disclaimer, the term of this patent is extended or adjusted under 35 U.S.C. 154(b) by 253 days.

(21) Appl. No.: 13/542,071

(22) Filed: Jul. 5, 2012

(65) Prior Publication Data

US 2013/0009534 A1 Jan. 10, 2013

(30) Foreign Application Priority Data

Jul. 6, 2011 (JP) ..... 2011-149943

(51) Int. Cl.
*H01T 13/16* (2006.01)
*H01T 21/02* (2006.01)
*H01T 13/50* (2006.01)

(52) U.S. Cl.
CPC ..... *H01T 13/16* (2013.01); *H01T 21/02* (2013.01); *H01T 13/50* (2013.01)
USPC ..... 313/120; 445/7

(58) Field of Classification Search
CPC ..... H01T 13/16; H01T 21/02; H01T 13/50
USPC ..... 313/120, 131 R; 445/7; 60/39.827
See application file for complete search history.

(56) References Cited

U.S. PATENT DOCUMENTS

| | | | | |
|---|---|---|---|---|
| 4,099,373 | A * | 7/1978 | Griffin et al. | 60/39.827 |
| 4,873,466 | A | 10/1989 | Matsumura et al. | 313/131 R |
| 8,181,440 | B2 * | 5/2012 | Sandelis | 60/39.821 |

FOREIGN PATENT DOCUMENTS

| | | | |
|---|---|---|---|
| JP | 59-040481 | 3/1984 | F02P 13/00 |
| JP | 63-66879 | 3/1988 | H01T 13/20 |
| JP | 1-267983 | 10/1989 | H01T 13/52 |
| JP | 1-267984 | 10/1989 | H01T 13/52 |
| JP | 1-274373 | 11/1989 | H01T 13/52 |
| JP | 1-274374 | 11/1989 | F02P 13/00 |
| JP | 1-286282 | 11/1989 | H01T 13/20 |
| RU | 2130222 C1 * | 5/1999 | |
| RU | 2136094 C1 * | 8/1999 | |

* cited by examiner

*Primary Examiner* — Karabi Guharay
(74) *Attorney, Agent, or Firm* — Kusner & Jaffe

(57) ABSTRACT

A ground electrode of an igniter plug has inlets for supplying cooling fluid therethrough to a first space formed between an insulator and the ground electrode, and first outlets located forward of the inlets and radially outward of the inner circumference of a ground electrode forward-end portion and adapted to discharge the cooling fluid therethrough. A second space communicating with the first space and having a second outlet for discharging the cooling fluid therethrough is formed between a forward end surface of the insulator and a surface of the ground electrode which faces the forward end surface.

10 Claims, 14 Drawing Sheets

FIG. 5

| DIMENSION (MM) | GROUND ELECTRODE TEMPERATURE (°C) | QTY OF CRACKED SAMPLES (UPON COMPLETION OF 10 CYCLES) |
|---|---|---|
| 0.00 (NO SPACE) | 1,000 | 0 |
| | 1,100 | 3 |
| | 1,200 | 5 |
| 0.05 | 1,000 | 0 |
| | 1,100 | 0 |
| | 1,200 | 0 |
| 0.10 | 1,000 | 0 |
| | 1,100 | 0 |
| | 1,200 | 0 |
| 0.15 | 1,000 | 0 |
| | 1,100 | 0 |
| | 1,200 | 0 |
| 0.20 | 1,000 | 0 |
| | 1,100 | 0 |
| | 1,200 | 0 |
| 0.25 | 1,000 | 0 |
| | 1,100 | 0 |
| | 1,200 | 0 |
| 0.30 | 1,000 | 0 |
| | 1,100 | 0 |
| | 1,200 | 0 |

<TEST CONDITIONS>
10 CYCLES, EACH CONSISTING OF HEATING FOR 1 MINUTE AND COOLING FOR 1 MINUTE (SUPPLY OF COOLING FLUID THROUGH INLETS)
CHECK FOR CRACKING EVERY 5 CYCLES
NUMBER N OF SAMPLES: 5

FIG. 6

| DIMENSION (mm) | SPARK ENDURANCE | SPARK HEIGHT |
|---|---|---|
| 0.00 (NO SPACE) | EXCELLENT | EXCELLENT |
| 0.05 | EXCELLENT | EXCELLENT |
| 0.10 | EXCELLENT | EXCELLENT |
| 0.15 | EXCELLENT | EXCELLENT |
| 0.20 | EXCELLENT | GOOD |
| 0.25 | GOOD | GOOD |
| 0.30 | GOOD | FAIR |

| | SPARK ENDURANCE | SPARK HEIGHT |
|---|---|---|
| EXCELLENT | 4.5 HOURS OR MORE | 6 mm OR GREATER |
| GOOD | 3.5 TO 4.5 HOURS | 4 TO 6 mm |
| FAIR | LESS THAN 3.5 HOURS | LESS THAN 4 mm |

FIG. 7

| FIXATION METHOD | SPECIFICATION | | HEATING | IMPACT TEST IN HEATED STATE | MEASUREMENT OF INSULATOR DETACHMENT LOAD |
|---|---|---|---|---|---|
| | | | | TEST TIME WHICH CAUSES LEAKAGE OF FILLER POWDER (min) | INSULATOR DETACHMENT LOAD (kg) |
| 1 | A | STANDARD | YES | NO LEAKAGE FOR 30 MINUTES | 280 |
| 2 | A | STANDARD | NO | 2 | 30 |
| 3 | B | POWDER CHARGING FORCE IMPROVED BY 20% | | 3 | 60 |
| 4 | C | NOT GLAZED | | 3 | 50 |

STANDARD SPECIFICATION A: TEMPORARY PRESSING FORCE 600 kg; POWDER CHARGING FORCE 1,000 kg; CRIMPING FORCE 2,000 kg; GLAZED

IGNITER PLUG WITH COOLING FLUID AND METHOD OF MANUFACTURING IGNITER PLUG

FIELD OF THE INVENTION

The present invention relates to an igniter plug and to a method of manufacturing the igniter plug.

BACKGROUND OF THE INVENTION

An igniter plug used in a gas turbine engine, a diesel engine, a burner igniter, etc., generally includes a center electrode, an insulator disposed externally of the center electrode, and a ground electrode (also called an "outer electrode") provided externally of the insulator. A forward end portion of the ground electrode; i.e., a ground electrode forward-end portion, forms a gap for discharge in cooperation with the center electrode. Herein, a side of the igniter plug toward the gap is called the "forward side," and a side opposite the forward side is called the "rear side."

In a conventional igniter plug, the insulator is fixed in the ground electrode such that its forward end surface (hereinafter, called the "insulator forward-end surface") is in contact with a surface of the ground electrode (hereinafter, called the "ground electrode counter surface") which faces the insulator forward-end surface in the axial direction.

In such an igniter plug, by use of cooling fluid (e.g., air) which flows in through inlets provided in a side wall of the ground electrode, the insulator, the ground electrode forward-end portion, and the center electrode are cooled. For example, cooling fluid flows through flow paths which extend from the inlets to outlets provided in the ground electrode forward-end portion. The outlets are disposed radially outward of the inner circumference of the ground electrode forward-end portion. The cooling fluid flows along an annular space formed between the insulator and the ground electrode, thereby cooling the insulator and the ground electrode forward-end portion (See, for example,) Japanese Patent Application Laid-Open (kokai) No. S59-040481.

In some cases, when the conventional igniter plug is heated to a high temperature, because of difference in coefficient of linear expansion between the insulator and the ground electrode, a gap is generated between the insulator forward-end surface and the ground electrode counter surface which are in contact with each other at room temperature. Also, in some cases, when a gap is generated between the insulator forward-end surface and the ground electrode counter surface, cooling fluid which flows through the cooling-fluid paths enters the gap and rapidly cools the insulator, causing cracking in the insulator by thermal shock (heat drop).

The present invention has been conceived to solve the above-mentioned conventional problem, and an object of the invention is to restrain cracking of an insulator of an igniter plug.

SUMMARY OF THE INVENTION

In order to solve, at least partially, the above problem, the present invention can be embodied in the following modes or application examples.

Application example 1 In accordance with a first aspect of the present invention, there is provided an igniter plug comprising a center electrode, an insulator having an axial bore extending in an axial direction and accommodating the center electrode therein. A ground electrode accommodates the insulator therein in such a manner as to form a first space between the ground electrode and at least a portion of an outer circumferential surface of the insulator. The ground electrode has a ground electrode forward-end portion which forms a gap in cooperation with the center electrode. With a side toward the gap being considered as a forward side along the axial direction, the ground electrode has an inlet for supplying cooling fluid therethrough to the first space. A first outlet is located forward of the inlet and radially outward of an inner circumference of the ground electrode forward-end portion and is adapted to discharge the cooling fluid therethrough. A second space communicating with the first space, and having a second outlet for discharging the cooling fluid therethrough, is formed between a forward end surface of the insulator, i.e., an insulator end surface, and a surface of the ground electrode which faces the insulator end surface, i.e., a ground electrode counter surface.

In the igniter plug of application example 1, because the second space, that communicates with the first space, is formed between the insulator and the ground electrode, and because the second outlet for discharging cooling fluid therethrough is formed between the insulator end surface and the ground electrode counter surface, cooling fluid supplied to the first space through the inlet flows through the second space and is discharged through the second outlet. By virtue of such a flow of cooling fluid, the insulator end surface is cooled at all times. Therefore, the insulator is free from rapid cooling from a high-temperature condition and cracking thereof can be restrained.

Application example 2 In accordance with a second aspect of the present invention, there is provided an igniter plug as described above, further comprising a seat member sandwiched in the axial direction between the insulator and the ground electrode and adapted to restrict a forward movement of the insulator relative to the ground electrode at a predetermined seating position located forward of the inlet, wherein the seat member has a slit extending in a radial direction at the seating position.

In the igniter plug of application example 2, even though the seating position of the insulator is located forward of the inlet, by virtue of provision, at the seating position, of the seat member having the radially extending slit, the second space can be reliably provided between the insulator end surface and the ground electrode counter surface, whereby cracking of the insulator can be restrained.

Application example 3 In accordance with a third aspect of the present invention, there is provided an igniter plug as described above with respect to application example 2, wherein the seating position is a position of the insulator end surface, and the seat member is formed from a metal having a melting point equal to or higher than that of the ground electrode.

In the igniter plug of application example 3, since the seating member can improve durability of the ground electrode, while cracking of the insulator is restrained, durability of the igniter plug can be improved without need to increase the number of components.

Application example 4 In accordance with a fourth aspect of the present invention, there is provided an igniter plug as described above with respect to application example 2, wherein the insulator has a first portion which encompasses the insulator end surface, and a second portion greater in diameter than the first portion, and the seating position is a position of a stepped portion which is a boundary between the first portion and the second portion.

In the igniter plug of application example 4, since the first portion which encompasses the insulator end surface is smaller in diameter than the second portion, an internal temperature difference of the insulator in the vicinity of the insulator end surface can be mitigated, whereby cracking of the insulator can be more reliably restrained. Also, in the igniter plug, since the seating position is the position of the stepped portion which is the boundary between the first portion and the second portion, a larger second space can be provided as compared with the case where the seating position of the insulator is the position of the insulator end surface, whereby cracking of the insulator can be more reliably restrained.

Application example 5 In accordance with a fifth aspect of the present invention, there is provided an igniter plug as described above with respect to application example 4, wherein an outer circumferential surface of the stepped portion forms an angle of 45 degrees or less with respect to the axial direction, and as viewed on a section which contains an axis of the igniter plug, the seat member at the seating position is in line contact with the outer circumferential surface of the stepped portion.

In the igniter plug of application example 5, since dimensional variations of the insulator along the axial direction can be absorbed by deformation of the seat member, the dimensional accuracy of the igniter plug can be improved without need to prepare various seat members of different dimensions and to select a seat member having an appropriate thickness.

Application example 6 In accordance with a sixth aspect of the present invention, there is provided an igniter plug as described above with respect to application examples 2 to 5, further comprising an electrode plate formed from a material having a melting point equal to or higher than that of the ground electrode, and disposed on the ground electrode counter surface, wherein the seat member is disposed on the electrode plate.

In the igniter plug of application example 6, a reduction in the volume of the electrode plate can be restrained, whereby deterioration in durability can be restrained.

Application example 7 In accordance with a seventh aspect of the present invention, there is provided an igniter plug as described above with respect to application examples 1 to 6, wherein the second space has a dimension of 0.25 mm or less as measured along the axial direction.

The igniter plug of application example 7 can provide good spark endurance and a good spark height.

Application example 8 In accordance with an eighth aspect of the present invention, there is provided an igniter plug as described above with respect to application example 7, wherein the second space has a dimension of 0.15 mm or less as measured along the axial direction.

The igniter plug of application example 8 can provide better spark endurance and a better spark height.

Application example 9 In accordance with a ninth aspect of the present invention, there is provided a method of manufacturing an igniter plug as described above, comprising a step of fixing the insulator and the ground electrode together through utilization of a filler powder and crimping, wherein the fixing step includes a step of heating the filler powder.

The method of manufacturing an igniter plug of application example 9 can enhance the force of fixation of the insulator to the ground electrode.

Application example 10 In accordance with a tenth aspect of the present invention, there is provided a method of manufacturing an igniter plug as described above, comprising the steps of disposing a flammable packing on the ground electrode counter surface of the ground electrode; inserting the insulator into the ground electrode until the insulator end surface comes into contact with a surface of the flammable packing; and burning off the flammable packing so as to convert a space occupied by the flammable packing into the second space.

According to the method of manufacturing an igniter plug of application example 10, the insulator can be fixed to the ground electrode without being affected by, for example, dimensional variations of the ground electrode and the insulator, so as to accurately form the second space having a predetermined size between the insulator end surface and the ground electrode counter surface.

The present invention can be implemented in various forms. For example, the present invention can be implemented in an igniter plug, a ground electrode for an igniter plug, and a seat member for an igniter plug, as well as in methods of manufacturing these products.

BRIEF DESCRIPTION OF THE DRAWINGS

FIG. 5 is a table showing the results of a thermal shock test conducted on the igniter plug 100.

FIG. 6 is a pair of tables showing the results of an evaluation test conducted on the igniter plug 100 for spark endurance and spark height.

FIG. 7 is a table showing the results of an evaluation test conducted on the igniter plug 100 for a fixation method for the insulator 30.

DETAILED DESCRIPTION OF PREFERRED EMBODIMENTS

Modes for carrying out the present invention will next be described with reference to specific embodiments in the following order.

A. First embodiment
A-1. Configuration of igniter plug
A-2. Insulator fixation method
A-3. Performance evaluation
B. Second embodiment
C. Modifications

A. First Embodiment

A-1. Configuration of Igniter Plug

Figure 1:
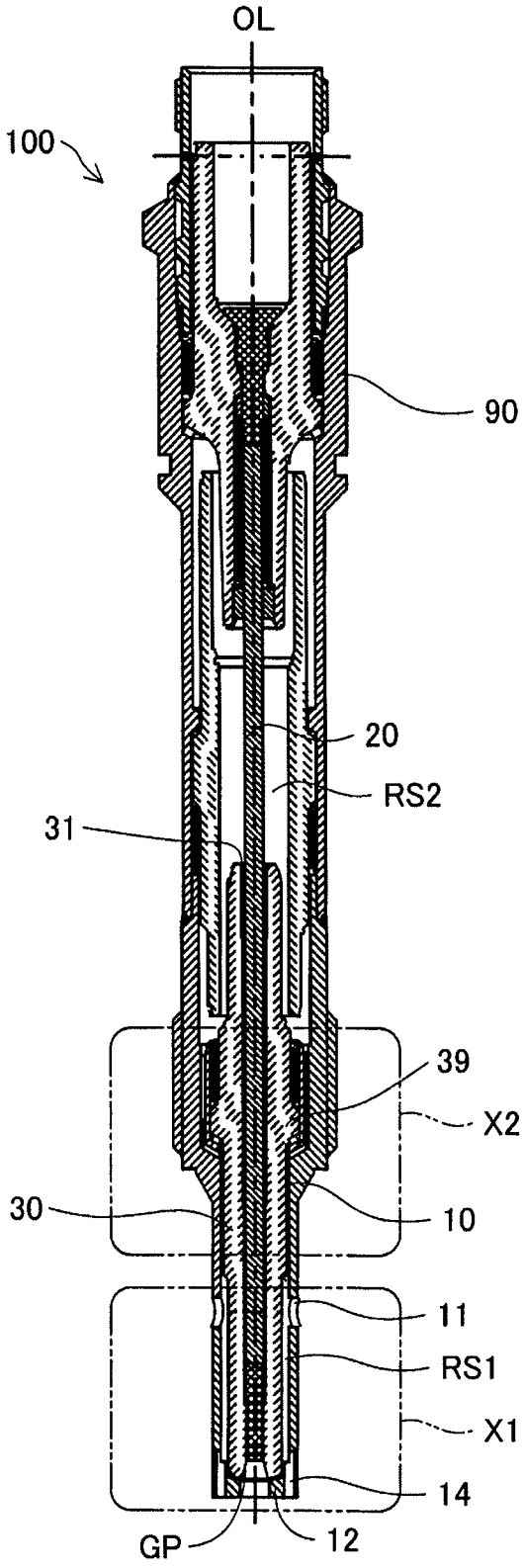
FIG. 1 is an explanatory view schematically showing the configuration of an igniter plug 100 according to a first embodiment of the present invention.
Figure 2A:
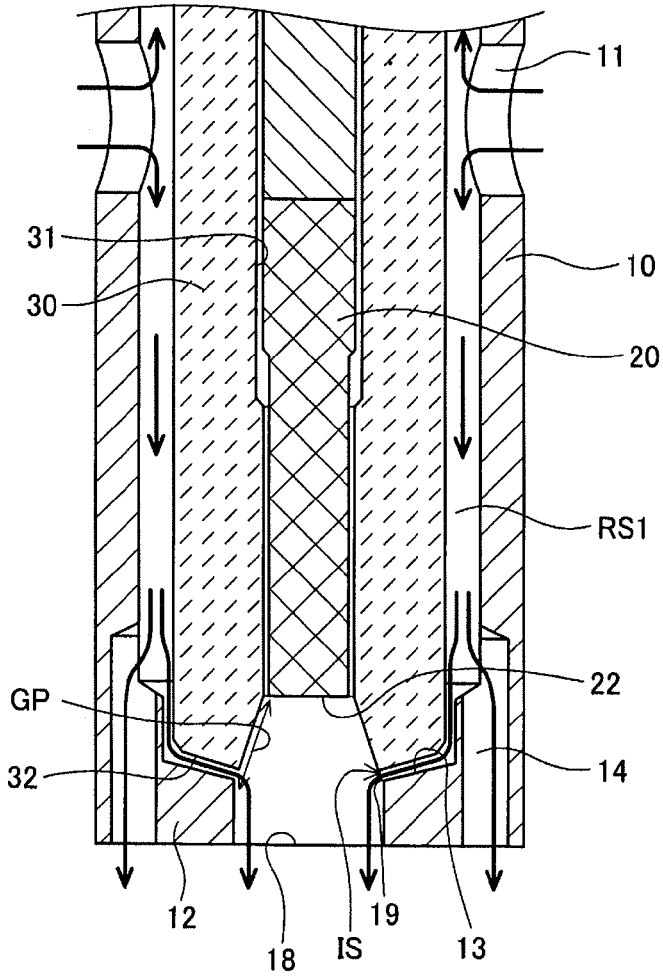
FIGS. 2(*a*) and 2(*b*) are a pair of explanatory views schematically showing the configuration of the igniter plug 100 according to the first embodiment of the present invention.
Figure 2B:
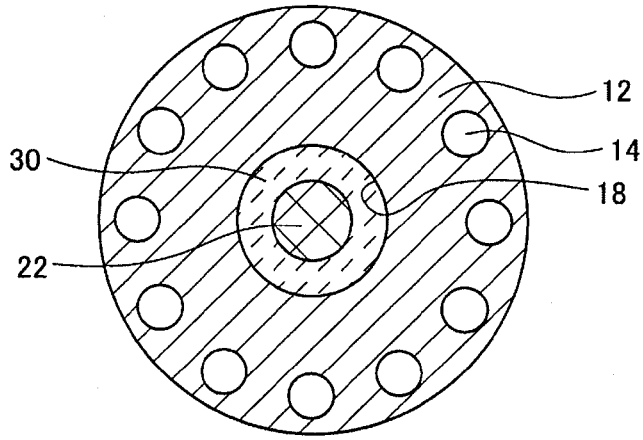
Figure 3:
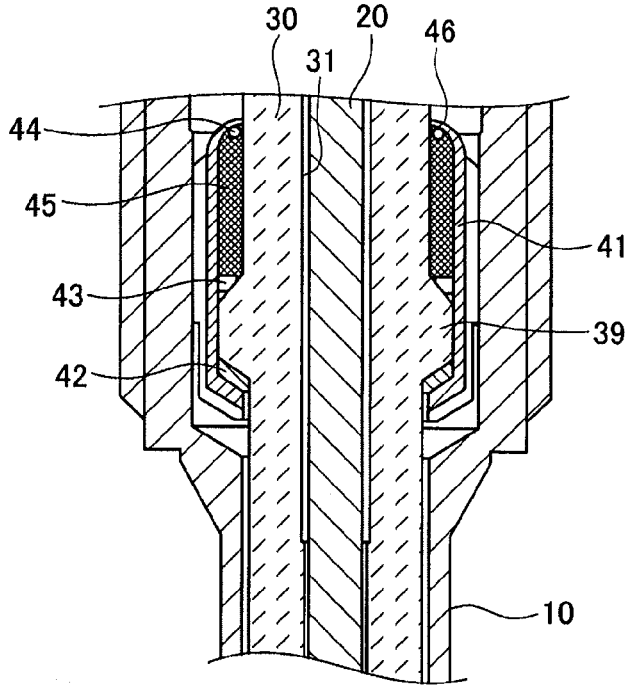
FIG. 3 is an explanatory view schematically showing the configuration of the igniter plug 100 according to the first embodiment of the present invention.

FIGS. 1 to 3 are explanatory views schematically showing the configuration of an igniter plug 100 according to a first embodiment of the present invention. FIG. 1 shows the overall configuration of the igniter plug 100 of the first embodiment. FIG. 2(*a*) shows, on an enlarged scale, the configuration of the X1 area of FIG. 1. FIG. 2(*b*) shows the planar configuration of a forwardmost portion of the igniter plug 100. FIG. 3 shows, on an enlarged scale, the configuration of the X2 area of FIG. 1. In the following description, a side toward a creepage gap GP, which will be described later, along an axis OL of the igniter plug 100 is called the forward side, and a side opposite the forward side is called the rear side.

The igniter plug 100 of the present embodiment is used in, for example, an aircraft gas turbine engine, a diesel engine, and a burner igniter and is a so-called lead-in surface type igniter plug.

As shown in FIG. 1, the igniter plug 100 includes a ground electrode 10, a center electrode 20, and an insulator 30. The center electrode 20 is a substantially rodlike electrode and is formed from, for example, a nickel alloy which contains nickel as a main component. In order to improve resistance to spark-induced erosion and resistance to oxidation-induced erosion, an electrode tip formed form, for example, a noble metal may be joined to the forward end of the center electrode 20.

The insulator 30 is a substantially cylindrical member having an axial bore 31, which is a through-hole extending along the axis OL, and is formed by firing a ceramic material, such as alumina. The insulator 30 accommodates the center electrode 20 in the axial bore 31. As shown in FIG. 2(*a*), the forward end surface of the center electrode 20 (hereinafter, called the "center electrode forward-end surface 22") accommodated in the axial bore 31 is located rearward of the forward end surface of the insulator 30 (hereinafter, called the "insulator forward-end surface 32"). A forwardmost portion of the axial bore 31 is tapered such that the inside diameter increases along the forward direction. As shown in FIG. 3, the insulator 30 has a center trunk portion 39 greater in outside diameter than the remaining portion.

The ground electrode 10 is a substantially cylindrical member and accommodates the insulator 30 therein. The ground electrode 10 is formed from a metal, such as low-carbon steel. As will be described later, the ground electrode 10 and the insulator 30 are fixed together at a position near the center trunk portion 39 of the insulator 30, and an annular space (hereinafter, called the "forward ring space RS1") is formed between the inner circumferential surface of the ground electrode 10 and the outer circumferential surface of a forward portion of the insulator 30 located forward of the center trunk portion 39. The forward ring space RS1 corresponds to the first space in the present invention. The ground electrode 10 has a plurality of inlets 11 formed therein for establishing communication between the external space around the igniter plug 100 and the forward ring space RS1. The number of the inlets 11 formed in the ground electrode 10 may be one.

In the igniter plug 100 of the present embodiment, a metallic shell 90 is connected to a rear end portion of the ground electrode 10. The ground electrode 10 and the metallic shell 90 may be a unitary member.

As shown in FIG. 2(*a*), the ground electrode 10 has a ground electrode forward-end portion 12 formed at the forwardmost location thereof. As shown in FIG. 2(*b*), the section of the ground electrode forward-end portion 12 taken perpendicularly to the axis OL has a substantially annular shape. A gap for discharge (hereinafter, called the "creepage gap GP") is formed between the ground electrode forward-end portion 12 and the center electrode 20. The creepage gap GP is formed along a surface of the insulator 30 corresponding to a tapered portion of the axial bore 31. A hollow portion of the ground electrode forward-end portion 12 is an opening (hereinafter, called the "spark opening 18") which opens upon the external space around the igniter plug 100. The spark opening 18 opens upon the taper portion of the axial bore 31 of the insulator 30 and the center electrode forward-end surface 22. When a high voltage is applied between the center electrode 20 and the ground electrode forward-end portion 12, discharge is generated across the creepage gap GP, and a plasma-like spark is discharged from the spark opening 18.

The ground electrode 10 has a plurality of first outlets 14 formed therein and located forward of the inlets 11 and adapted to establish communication between the external space around the igniter plug 100 and the forward ring space RS1. The first outlets 14 are disposed radially outward of the inner circumference of the ground electrode forward-end portion 12. The number of the first outlets 14 formed in the ground electrode 10 may be one.

As indicated by the arrows in FIG. 2(*a*), the inlets 11, the forward ring space RS1, and the first outlets 14 constitute a cooling fluid flow path. In use of the igniter plug 100, cooling fluid (e.g., air) is supplied to the forward ring space RS1 through the inlets 11, and the supplied cooling fluid flows forward in the forward ring space RS1 and is then discharged to the external space through the first outlets 14. Such a flow of cooling fluid mainly cools the outer circumferential surfaces of the insulator 30 and the ground electrode forward-end portion 12. A portion of cooling fluid supplied to the forward ring space RS1 through the inlets 11 flows forward through the gap between the center electrode 20 and the insulator 30 via an annular space (hereinafter, called the "rear ring space RS2;" see FIG. 1) formed rearward of the center trunk portion 39, and is then discharged from the spark opening 18. Such a flow of cooling fluid mainly cools the outer circumferential surface of the center electrode 20 and the inner circumferential surfaces of the insulator 30 and the ground electrode forward-end portion 12.

Also, in the present embodiment, as shown in FIG. 2(*a*), a space (hereinafter, called the "end interfacial space IS") is formed between the insulator forward-end surface 32 and a surface (hereinafter, called the "ground electrode counter surface 13") of the ground electrode 10 (the ground electrode forward-end portion 12) which faces the insulator forward-end surface 32 in the direction of the axis OL. The end interfacial space IS corresponds to the second space in the present invention. The end interfacial space IS communicates with the forward ring space RS1 and has a second outlet 19 which communicates with a space where the creepage gap GP is formed. Thus, as indicated by the arrows in FIG. 2(*a*), a portion of cooling fluid supplied to the forward ring space RS1 flows into the end interfacial space IS; is discharged, via the second outlet 19, to the space where the creepage gap GP is formed; subsequently, is discharged to the external space from the spark opening 18. Such a flow of cooling fluid mainly cools the insulator forward-end surface 32, the ground electrode counter surface 13, and their vicinities.

In the present embodiment, the insulator forward-end surface 32 is not perpendicular to the axis OL, but is slightly inclined from a plane perpendicular to the axis OL. Also, the ground electrode counter surface 13 is substantially parallel to the insulator forward-end surface 32. Therefore, the size of the end interfacial space IS (the dimension of the end interfacial space IS along the axis OL) is substantially fixed.

As shown in FIG. 3, the insulator 30 is fixed to the ground electrode 10 at a position near the center trunk portion 39 by use of a substantially tubular pressing metal member 41. More specifically, the diameter of a forward end portion of the pressing metal member 41 is smaller than the outside diameter of the center trunk portion 39. The forward end portion of the pressing metal member 41 is disposed forward of the center trunk portion 39 and is in contact with the center trunk portion 39 via a packing 42. In the present embodiment, the contact position is a seating position where a forward movement of the insulator 30 relative to the ground electrode 10 is restricted. Thus, by means of the thickness of the packing 42 being adjusted, the size of the end interfacial space IS can be adjusted. Also, a packing 43, a filler powder (e.g., talc) 45, and a packing 44 are disposed in a space between the pressing metal member 41 and the insulator 30 located rearward of the center trunk portion 39. A rear end portion of the pressing metal member 41 (a pressing-metal-member rear end portion 46) is crimped. The insulator 30 is fixed to the ground electrode 10 in such a configuration. The pressing metal member 41 has flow channel grooves formed on its outer circumferential surface and extending along the axis OL. The above-mentioned forward ring space RS1 and rear ring space RS2 communicate with each other via the flow channel grooves.

A-2. Insulator Fixation Method

Figure 4:
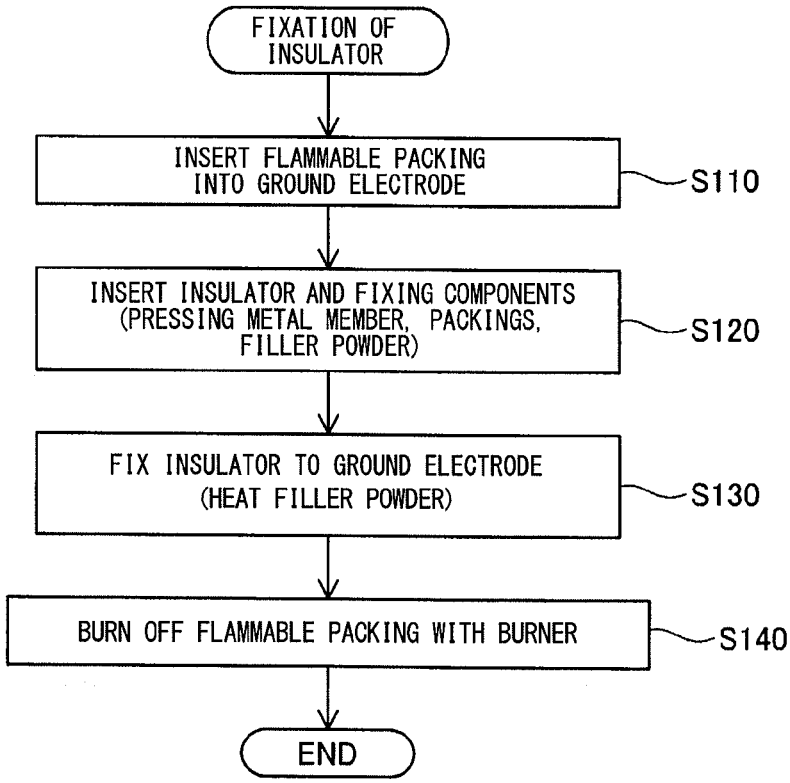
FIG. 4 is a flowchart showing a fixation method for an insulator 30 in the course of manufacture of the igniter plug 100 according to the first embodiment.

FIG. 4 is a flowchart showing a method of fixing the insulator 30 in place in the course of manufacture of the igniter plug 100 of the first embodiment. First, a packing formed from a flammable material (e.g., paper or wood) is inserted into the bore of the ground electrode 10 (step S110). The inserted flammable packing (not shown) is disposed on the ground electrode counter surface 13 (see FIG. 2(*a*)). The thickness of the flammable packing corresponds to the size of the end interfacial space IS (the dimension, along the axis OL, of the end interfacial space IS) to be formed.

Next, the insulator 30, and components for fixing the insulator 30 to the ground electrode 10 are inserted into the bore of the ground electrode 10 (step S120). Specifically, first, the pressing metal member 41 and the packing 42 are inserted; next, the insulator 30 is inserted; subsequently, the packing 43 is inserted, and then the filler powder 45 is charged; finally, the packing 44 is inserted. By this procedure, the inserted insulator 30 is disposed on the flammable packing which has been previously disposed on the ground electrode counter surface 13, whereby the insulator forward-end surface 32 comes into contact with the surface of the flammable packing. In this condition, the pressing-metal-member rear end portion 46 of the pressing metal member 41 is crimped for fixing the insulator 30 to the ground electrode 10, and the filler powder 45 is heated (e.g., at 700° C. for 180 minutes in an electric furnace) (step S130).

Finally, the flammable packing is burned off by means of a burner (step S140). By this procedure, the end interfacial space IS whose size corresponds to the thickness of the flammable packing is formed between the insulator forward-end surface 32 and the ground electrode counter surface 13. By the method described above, the insulator 30 can be fixed to the ground electrode 10 in such a manner as to accurately form the end interfacial space IS having a predetermined size between the insulator forward-end surface 32 and the ground electrode counter surface 13 without being affected by, for example, dimensional variations of the ground electrode 10 and the insulator 30.

A-3. Performance Evaluation

A performance evaluation test was conducted on the igniter plugs 100 of the present embodiment described above. FIG. 5 is an explanatory table showing the results of a thermal shock test on the igniter plugs 100. The thermal shock test was conducted on a plurality of samples which differed in the size (the dimension along the axis OL) of the end interfacial space IS formed between the insulator forward-end surface 32 and the ground electrode counter surface 13, and examined the insulators 30 for cracking upon exposure to heating and cooling cycles. Seven types of samples were prepared; specifically, six types have a dimension along the axis OL of the end interfacial space IS of 0.05 mm, 0.10 mm, 0.15 mm, 0.20 mm, 0.25 mm, and 0.30 mm, respectively, and the remaining one type, as a comparative example, has no end interfacial space IS (a dimension along the axis OL of the end interfacial space IS of 0.00 mm). Three test temperatures; i.e., 1,000° C., 1,100° C., and 1,200° C., were employed as measured at the forwardmost end portions (spark portions) of the ground electrodes 10. The samples were exposed to 10 heating and cooling cycles, each consisting of heating for one minute by use of a burner and cooling for one minute by means of supply of cooling fluid through the inlets 11, and were examined for cracking of the insulator 30 every five cycles. The number n of samples was five for each combination of the sample type and the test temperature.

As shown in FIG. 5, the samples having no end interfacial space IS (the samples of the comparative example) were free from cracking of the insulator 30 at a test temperature of 1,000° C. However, at a test temperature of 1,100° C., three samples suffered cracking of the insulator 30, and at a test temperature of 1,200° C., all of the samples (five samples) suffered cracking of the insulator 30. The test results have revealed that an igniter plug which has no end interfacial space IS at room temperature, as a result of the insulator forward-end surface 32 and the ground electrode counter surface 13 being in contact with each other, may suffer cracking of the insulator 30. It is believed that cracking occurred for the following reason: at a certain temperature, the difference in coefficient of linear expansion between the insulator 30 and the ground electrode 10 (the ground electrode forward-end portion 12) causes the generation of a gap between the insulator forward-end surface 32 and the ground electrode counter surface 13, and cooling fluid enters the gap and rapidly cools the insulator 30, causing cracking in the insulator 30 by thermal shock (heat drop).

By contrast, the samples having the end interfacial space IS between the insulator forward-end surface 32 and the ground electrode counter surface 13 (the samples corresponding to the present embodiment) are free from cracking of the insulator 30 at the test temperatures, regardless of the size of the end interfacial space IS. Conceivably, this is for the following reason. By virtue of the existence of the end interfacial space IS between the insulator forward-end surface 32 and the ground electrode counter surface 13 at room temperature, the insulator forward-end surface 32 is cooled at all times by cooling fluid which flows through the end interfacial space IS; therefore, the insulator 30 is free from rapid cooling from a high-temperature condition and thus cracking thereof can be restrained.

FIG. 6 is an explanatory table showing the results of an evaluation test conducted on the igniter plugs 100 for spark endurance and spark height. The spark endurance test was conducted on seven types of samples as in the case of the above-mentioned thermal shock test, and the samples were examined for the duration in which ignition was able to be repeatedly executed. In the igniter plug 100, the repeated execution of ignition causes wear of the electrodes; as a result, the creepage gap GP increases, so that misfire becomes more likely to arise. Thus, conceivably, the greater the size (the dimension along the axis OL) of the end interfacial space IS, the more the spark endurance tends to deteriorate. In the spark endurance test, the samples which exhibited a duration of 4.5 hours or more were evaluated as "Excellent;" the samples which exhibited a duration of 3.5 hours to less than 4.5 hours were evaluated as "Good;" and the samples which exhibited a duration of less than 3.5 hours were evaluated as "Fair."

As shown in FIG. 6, in the spark endurance test, all of the samples exhibited good spark endurance. The samples having a size of the end interfacial space IS of 0.20 mm or less exhibited excellent spark endurance.

The spark height test was conducted on seven types of samples as in the case of the above-mentioned thermal shock test, and the samples were examined for spark height (the length of projection of spark from the forwardmost end surface of the igniter plug 100). In the igniter plug 100, the greater the size (the dimension along the axis OL) of the end interfacial space IS, the more the spark height tends to reduce due to the phenomenon that spark penetrates into the end interfacial space IS (spark penetration). In the spark height test, the samples which exhibited a spark height of 6 mm or more were evaluated as "Excellent;" the samples which exhibited a spark height of 4 mm to less than 6 mm were evaluated as "Good;" and the samples which exhibited a spark height of less than 4 mm were evaluated as "Fair."

As shown in FIG. 6, in the spark height test, the samples having a size of the end interfacial space IS of 0.25 mm or less exhibited a large (good) spark height. The samples having a size of the end interfacial space IS of 0.15 mm or less exhibited a considerably large (excellent) spark height.

The results of the spark endurance test and the spark height test shown in FIG. 6 have revealed the following: in view of attainment of good spark endurance and good spark height, a size of the end interfacial space IS of 0.25 mm or less is preferred, and a size of the end interfacial space IS of 0.15 mm or less is more preferred.

FIG. 7 is an explanatory table showing the results of an evaluation test conducted on the igniter plugs 100 for the fixation method of the insulator 30. In the fixation method evaluation test, igniter plugs manufactured through employment of four kinds of methods (methods 1 to 4) for fixing the insulator 30 to the ground electrode 10 were subjected to an impact test according to JIS B8031 performed in a heated state (hereinafter referred to as the "impact test in a heated state") and were measured for insulator detachment load. The test conditions of the impact test in a heated state are as follows: stroke 3 mm; spark portion temperature 800° C. to 900° C.; and seat temperature 150° C.

Fixation methods 1 to 4 for the insulator 30 are defined by a combination of specification for fixation (specifications A to C) and whether or not heating of the filler powder 45 is employed in the course of fixation. Standard specification A for fixation is as follows: the insulator 30 is inserted into the ground electrode 10 and temporarily pressed by a force of 600 kg; the filler powder 45 is charged by a charging force of 1,000 kg; and the pressing-metal-member rear end portion 46 is crimped by a crimping force of 2,000 kg. Specification B is identical to specification A except that the charging force for the filler powder 45 is increased by 20% from that of specification A (i.e., the powder charging force is 1,200 kg). In specifications A and B, the insulator 30 is glazed. Specification C is identical to specification A except that the insulator 30 is not glazed. In fixation method 1, the insulator 30 is fixed according to standard specification A; then, the filler powder 45 is heated. In fixation methods 2 to 4, the insulator 30 is fixed according to standard specifications A to C, respectively, and the filler powder 45 is not heated.

In the impact test in a heated state, the sample prepared by fixation method 1 was free from leakage of the filler powder 45 for 30 minutes and exhibited a very large detachment load of the insulator 30 of 280 kg. The samples prepared by fixation methods 2 to 4 suffered leakage of the filler powder 45 in two to three minutes after start of the impact test and exhibited a small detachment load of the insulator 30 of 30 kg, 60 kg, and 50 kg, respectively.

As is apparent from the test results shown in FIG. 7 and comparison between specifications A and C for fixation, whether or not the filler powder 45 is heated has a great effect on the force of fixation of the insulator 30. That is, in view of enhancement of the force of fixation of the insulator 30, preferably, the filler powder 45 is heated in the course of fixation of the insulator 30 to the ground electrode 10.

As described above, in the igniter plug 100 of the present embodiment, the ground electrode 10 has the inlets 11 which communicate with the forward ring space RS1 formed between the ground electrode 10 and the insulator 30, and the first outlets 14 located forward of the inlets 11 and radially outward of the inner circumference of the ground electrode forward-end portion 12. Furthermore, the end interfacial space IS communicating with the forward ring space RS1 and having the second outlet 19 for discharging cooling fluid therethrough is formed between the insulator forward-end surface 32 and the ground electrode counter surface 13. Thus, the insulator forward-end surface 32 is cooled at all times by cooling fluid which flows through the end interfacial space IS. Therefore, the insulator 30 is free from rapid cooling from a high-temperature condition and thus cracking thereof can be restrained. When the end interfacial space IS is formed between the insulator forward-end surface 32 and the ground electrode counter surface 13, as compared with the case where the end interfacial space IS is not formed, heat conduction between the insulator 30 and the ground electrode 10 reduces. Thus, for example, even when the ground electrode forward-end portion 12 is rapidly cooled in use as a result of attachment of fuel to the ground electrode forward-end portion 12, rapid cooling of the insulator 30 which could otherwise result from heat conduction from the ground electrode forward-end portion 12 can be restrained. Also from this aspect, cracking of the insulator 30 can be restrained.

Also, in the igniter plug 100 of the present embodiment, in view of attainment of good spark endurance and good spark height, the size of the end interfacial space IS is preferably 0.25 mm or less, more preferably 0.15 mm or less.

In manufacture of the igniter plug 100 of the present embodiment, since the filler powder 45 is heated in the course of fixation of the insulator 30 to the ground electrode 10, the force of fixation of the insulator 30 can be enhanced. Also, in manufacture of the igniter plug 100 of the present embodiment, a flammable packing is placed on the ground electrode counter surface 13; the insulator 30 is inserted into the ground electrode 10 until the insulator forward-end surface 32 comes into contact with the surface of the flammable packing; and then the flammable packing is burned off so as to convert a space occupied by the flammable packing into the end interfacial space IS. Therefore, the insulator 30 can be fixed to the ground electrode 10 in such a manner as to accurately form the end interfacial space IS having a predetermined size between the insulator forward-end surface 32 and the ground electrode counter surface 13 without being affected by, for example, dimensional variations of the ground electrode 10 and the insulator 30.

B. Second Embodiment

Figure 8:
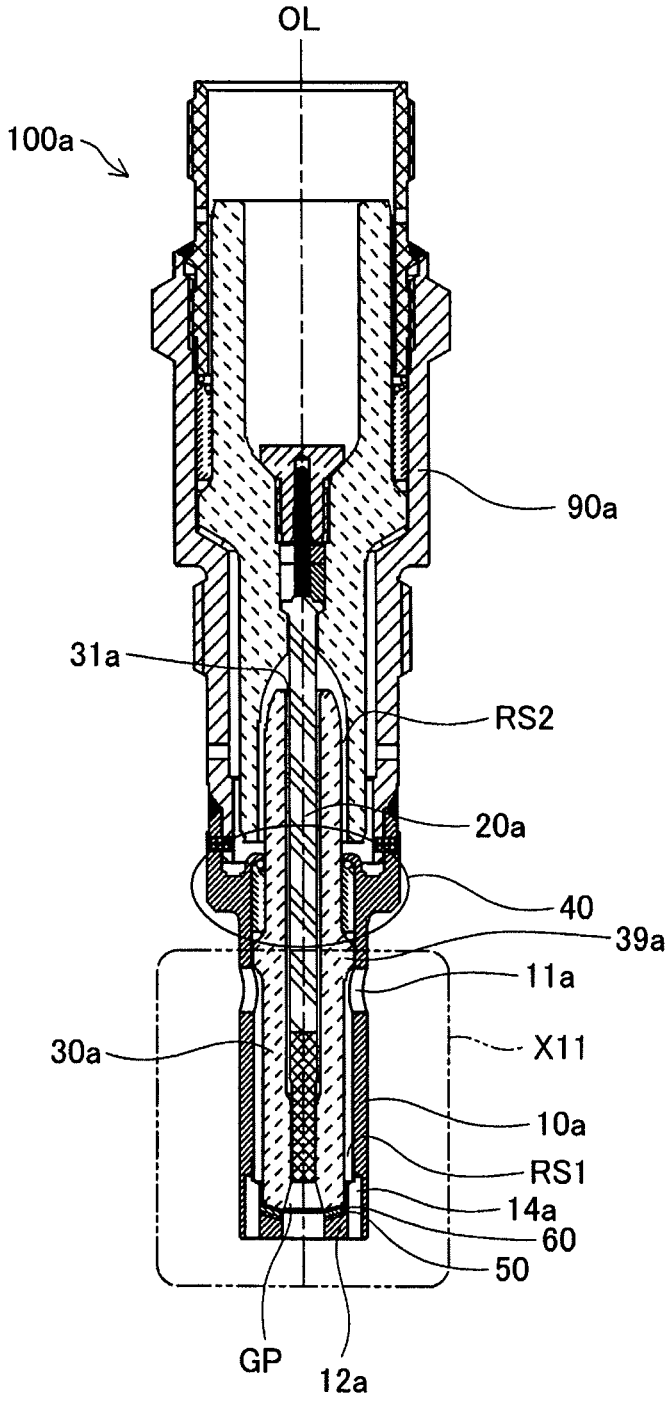
FIG. 8 is an explanatory view schematically showing the configuration of an igniter plug 100*a* according to a second embodiment of the present invention.
Figure 9A:
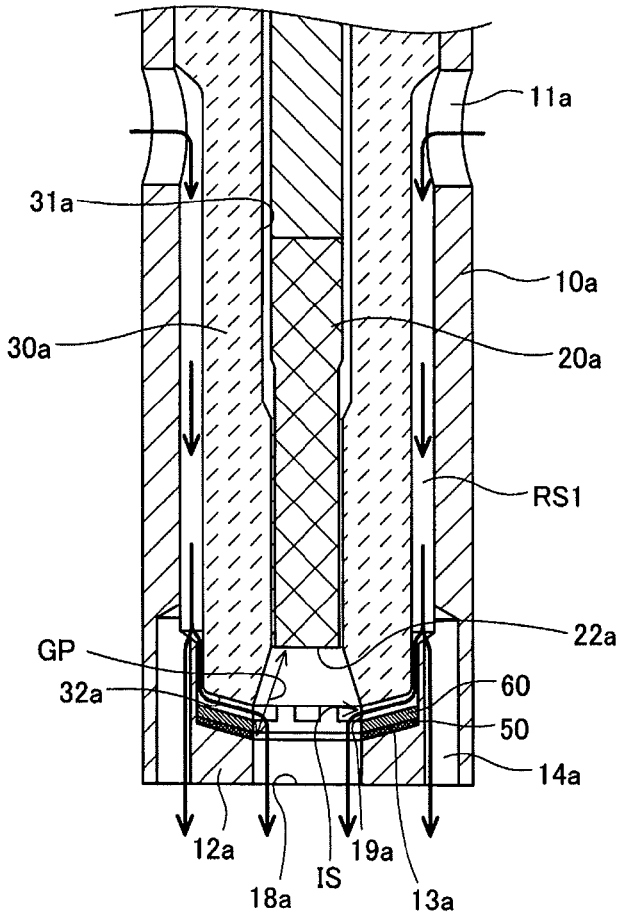
FIGS. 9(*a*), 9(*b*) and 9(*c*) are explanatory views schematically showing the configuration of the igniter plug 100*a* according to the second embodiment of the present invention.
Figure 9B:
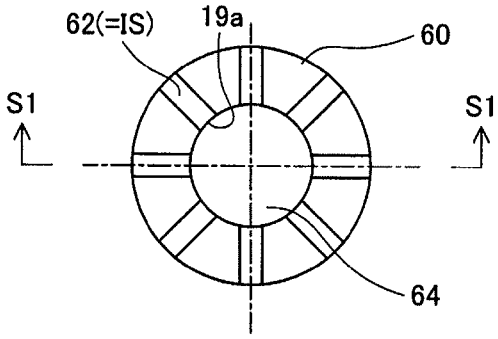
Figure 9C:
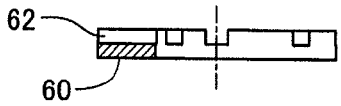

FIGS. 8 and 9 are explanatory views schematically showing the configuration of an igniter plug 100*a* according to a second embodiment of the present invention. The igniter plug 100*a* of the second embodiment differs from the above-described first embodiment mainly in the method of seating an insulator 30*a* on a ground electrode 10*a*. Herein, in distinctive description of embodiments, modifications of the embodiments, and comparative examples, distinctive symbols, such as alphabetic letters, are suffixed onto reference numerals. In common description of embodiments, modifications of the embodiments, and comparative examples, the distinctive symbols may be omitted as appropriate.

FIG. 8 shows the overall configuration of the igniter plug 100*a* of the second embodiment. FIG. 9(*a*) shows, on an enlarged scale, the configuration of the X11 area of FIG. 8; FIG. 9(*b*) shows the planar configuration of an end-surface packing 60, which will be described later, as viewed from the rear side; and FIG. 9(*c*) shows the side configuration (the right half of FIG. 9(*c*)) of the end-surface packing 60 and the sectional configuration (the left half of FIG. 9(*c*)) of the end-surface packing 60 taken along the line S1-S1 of FIG. 9(*b*).

As shown in FIG. 8, similar to the first embodiment described above, the igniter plug 100*a* of the second embodiment is a so-called lead-in surface type igniter plug and includes the ground electrode 10*a*, a center electrode 20*a*, and the insulator 30*a*. The insulator 30*a* is fixed to the ground electrode 10*a* at a fixation portion 40 located rearward of a center trunk portion 39*a*.

However, as shown in FIG. 9(*a*), in the second embodiment, a seating position where a forward movement of the insulator 30*a* relative to the ground electrode 10*a* is restricted is not the position of the fixation portion 40 located rearward of inlets 11*a*, but is the position of an insulator forward-end surface 32*a* located forward of the inlets 11*a*. That is, an electrode plate 50 is disposed on a ground electrode counter surface 13*a* of the ground electrode 10*a*, and the end-surface packing 60 is disposed on the electrode plate 50. The insulator 30*a* is disposed on the end-surface packing 60, and a forward movement of the insulator 30*a* is restricted at the position of the insulator forward-end surface 32*a* (the position of the rear-side surface of the end-surface packing 60).

The electrode plate 50 is a substantially annular disk member disposed for improving resistance to spark-induced erosion and resistance to oxidation-induced erosion of a ground electrode forward-end portion 12*a*. The electrode plate 50 is formed from a metal (e.g., tungsten, platinum, iridium, or rhodium) having a melting point higher than that of the ground electrode 10*a* (the ground electrode forward-end portion 12*a*). The electrode plate 50 is inserted into a bore of the ground electrode 10*a*; is placed on the ground electrode counter surface 13*a*; and is fixed by resistance welding.

The end-surface packing 60 is a substantially annular member having a center hole 64 and is formed from, for example, a nickel alloy which contains nickel as a main component. The end-surface packing 60 has slits 62 which are provided on its rear-side surface and radially extend between the center hole 64 and the outer circumference of the end-surface packing 60. After the electrode plate 50 is disposed on the ground electrode counter surface 13*a*, the end-surface packing 60 is inserted into the bore of the ground electrode 10*a*, and then the insulator 30*a* is inserted and pressed. By this procedure, the insulator forward-end surface 32*a* comes into contact with surfaces of portions other than the slits 62 of the end-surface packing 60, whereby the insulator 30*a* is seated in place. That is, the end-surface packing 60 functions as a seat member for the insulator 30*a*. In this condition, the slits 62 of the end-surface packing 60 collectively serve as the end interfacial space IS formed between the insulator forward-end surface 32*a* and the ground electrode counter surface 13*a*.

In the second embodiment, by means of adjustment of the depth of the slits 62 of the end-surface packing 60, the size of the end interfacial space IS (the dimension along the axis OL of the end interfacial space IS) can be adjusted. Also, by means of adjustment of the planar shape and the number of the slits 62 of the end-surface packing 60, the volume of the end interfacial space IS can be adjusted. Also, in the present embodiment, since the insulator forward-end surface 32*a* is slightly inclined from a plane perpendicular to the axis OL, the end-surface packing 60 is pressed by the insulator forward-end surface 32*a* and deformed, whereby close contact is established between the surface of the end-surface packing 60 and the insulator forward-end surface 32*a*.

The end interfacial space IS implemented by the slits 62 of the end-surface packing 60, similar to the first embodiment, communicates with the forward ring space RS1 and has a second outlet 19*a* which communicates with a space where the creepage gap GP is formed. Thus, as indicated by the arrows in FIG. 9(*a*), a portion of cooling fluid supplied to the forward ring space RS1 through the inlets 11*a* flows into the end interfacial space IS; is discharged, via the second outlet 19*a*, to the space where the creepage gap GP is formed; and subsequently, is discharged to the external space from a spark opening 18*a*. In the second embodiment, since such a flow of cooling fluid cools the insulator forward-end surface 32*a* at all times, the insulator 30*a* is free from rapid cooling from a high-temperature condition and thus cracking thereof can be restrained.

Also, since the end interfacial space IS exists between the insulator forward-end surface 32*a* and the ground electrode counter surface 13*a*, heat conduction between the insulator 30*a* and the ground electrode 10*a* reduces. Thus, for example, even when the ground electrode forward-end portion 12*a* is rapidly cooled as a result of attachment of fuel to the ground electrode forward-end portion 12*a*, rapid cooling of the insulator 30*a* which could otherwise result from heat conduction from the ground electrode forward-end portion 12*a* can be restrained. Also from this aspect, cracking of the insulator 30*a* can be restrained.

As described above, in the second embodiment, even though the seating position of the insulator 30*a* is located forward of the inlets 11*a* (specifically, the position of the insulator forward-end surface 32*a*), by means of the end-surface packing 60 having the radially extending slits 62 being used as a seat member at the seating position, the end interfacial space IS communicating with the forward ring space RS1 and having the second outlet 19*a* can be formed between the insulator forward-end surface 32*a* and the ground electrode counter surface 13*a*, whereby cracking of the insulator 30*a* can be restrained.

First Modification of Second Embodiment

Figure 10A:
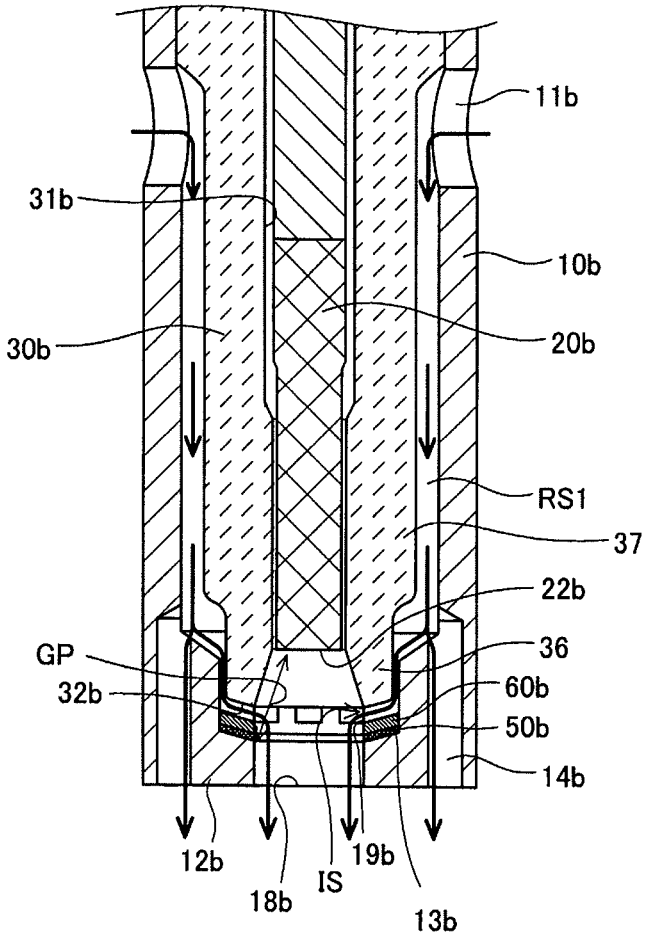
FIGS. 10(*a*), 10(*b*) and 10(*c*) are explanatory views schematically showing the configuration of a forward end portion of an igniter plug according to a first modification of the second embodiment.
Figure 10B:
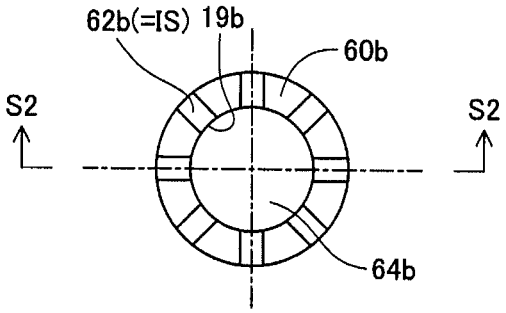
Figure 10C:
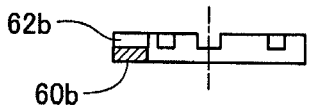

FIG. 10 is a set of explanatory views schematically showing the configuration of a forward end portion of an igniter plug according to a first modification of the second embodiment. FIG. 10(*a*) shows the sectional configuration of a forward end portion of the igniter plug. FIG. 10(*b*) shows the planar configuration of an end-surface packing 60*b* as viewed from the rear side. FIG. 10(*c*) shows the side configuration (the right half of FIG. 10(*c*)) of the end-surface packing 60*b* and the sectional configuration (the left half of FIG. 10(*c*)) of the end-surface packing 60*b* taken along the line S2-S2 of FIG. 10(*b*).

The first modification of the second embodiment shown in FIG. 10 differs from the second embodiment shown in FIG. 9 in that a portion of an insulator 30*b* (hereinafter, called the "small-diameter portion 36") encompassing an insulator forward-end surface 32*b* is smaller in diameter than a portion of the insulator 30*b* (hereinafter, called the "large-diameter portion 37") located rearward of the small-diameter portion 36 and that a ground electrode forward-end portion 12*b*, an electrode plate 50*b*, and an end-surface packing 60*b* are shaped so as to correspond to the small-diameter portion 36. Other configurational features are similar to those of the second embodiment. Specifically, the insulator 30*b* in the first modification of the second embodiment is shaped such that an outer circumferential portion is removed from a forwardmost end portion of the insulator 30*a* in the second embodiment shown in FIG. 9. Thus, the insulator forward-end surface 32*b* of the insulator 30*b* is smaller than that in the second embodiment shown in FIG. 9. Therefore, a ground electrode counter surface 13*b* of a ground electrode 10*b*, the plane of the electrode plate 50*b*, and the plane of the end-surface packing 60*b* become smaller in size according to the insulator forward-end surface 32*b*. The small-diameter portion 36 corresponds to the first portion in the present invention, and the large-diameter portion 37 corresponds to the second portion in the present invention.

In the first modification of the second embodiment, similar to the second embodiment described above, the insulator 30*b* is seated on the end-surface packing 60*b*, which serves as a seat member, at a position located forward of inlets 11*b* (specifically, the position of the insulator forward-end surface 32*b*). Also, slits 62*b* of the end-surface packing 60*b* collectively serve as the end interfacial space IS formed between the insulator forward-end surface 32*b* and the ground electrode counter surface 13*b*. The end interfacial space IS communicates with the forward ring space RS1 and has a second outlet 19*b* which communicates with a space where the creepage gap GP is formed. Thus, as indicated by the arrows in FIG. 10(*a*), a portion of cooling fluid supplied to the forward ring space RS1 through the inlets 11*b* flows into the end interfacial space IS; is discharged, via the second outlet 19*b*, to the space where the creepage gap GP is formed; and subsequently, is discharged to the external space from a spark opening 18*b*. Since such a flow of cooling fluid cools the insulator forward-end surface 32*b* at all times, the insulator 30*b* is free from rapid cooling from a high-temperature condition and thus cracking thereof can be restrained.

Furthermore, in the first modification of the second embodiment, since a forwardmost end portion (a portion encompassing the insulator forward-end surface 32*b*) of the insulator 30*b* assumes the form of the small-diameter portion 36, an internal temperature difference of the insulator 30*b* can be mitigated, whereby cracking of the insulator 30*b* can be more reliably restrained.

Figure 11A:
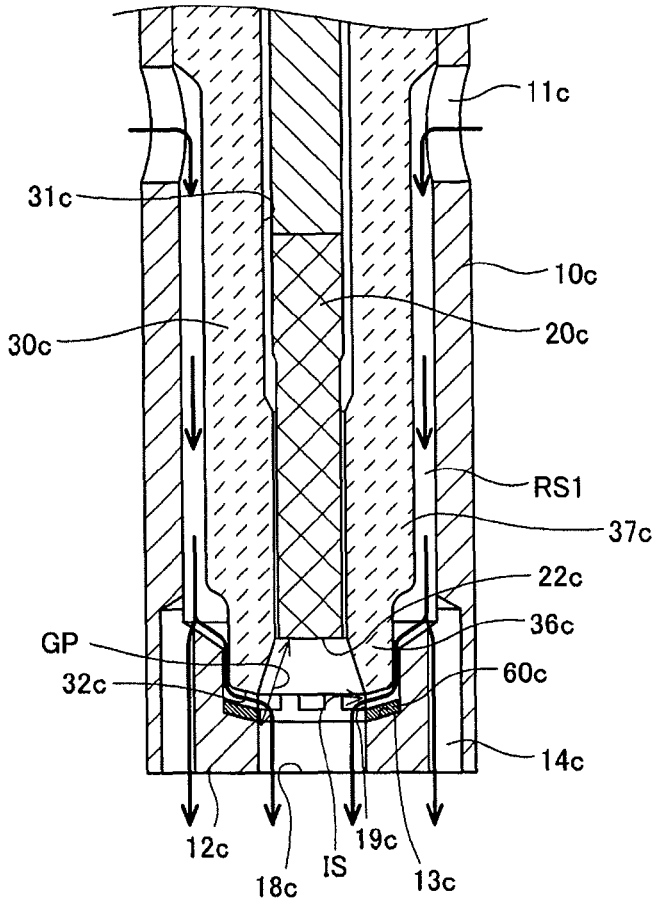
FIGS. 11(*a*), 11(*b*) and 11(*c*) are explanatory views schematically showing the configuration of a forward end portion of an igniter plug according to a second modification of the second embodiment.
Figure 11B:
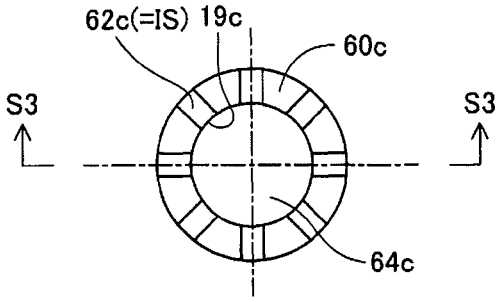
Figure 11C:
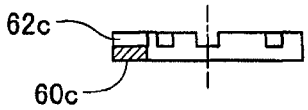

Second modification of second embodiment FIGS. 11(*a*), 11(*b*) and 11(*c*) are explanatory views schematically showing the configuration of a forward end portion of an igniter plug according to a second modification of the second embodiment. FIG. 11(*a*) shows the sectional configuration of a forward end portion of the igniter plug. FIG. 11(*b*) shows the planar configuration of an end-surface packing 60*c* as viewed from the rear side. FIG. 11(*c*) shows the side configuration (the right half of FIG. 11(*c*)) of the end-surface packing 60*c* and the sectional configuration (the left half of FIG. 11(*c*)) of the end-surface packing 60*c* taken along the line S3-S3 of FIG. 11(*b*).

The second modification of the second embodiment shown in FIG. 11 differs from the above-described first modification of the second embodiment shown in FIG. 10 in that the end-surface packing 60*c* functions as the electrode plate 50*b* in the first modification of the second embodiment, and other configurational features are similar to those of the first modification of the second embodiment. Specifically, in the second modification of the second embodiment, the end-surface packing 60*c* is disposed on a ground electrode counter surface 13*c* of a ground electrode 10*c*, and an insulator 30*c* is disposed on the end-surface packing 60*c*. The end-surface packing 60*c* is formed from a metal having a melting point equal to or higher than that of a ground electrode forward-end portion 12*c* and improves resistance to spark-induced erosion and resistance to oxidation-induced erosion of the ground electrode forward-end portion 12*c*. The end-surface packing 60*c* is inserted into a bore of the ground electrode 10*c*; is placed on the ground electrode counter surface 13*c*; and is fixed by resistance welding. The end-surface packing 60*c* has a plurality of slits 62*c* formed on its rear-side surface. The slits 62*c* of the end-surface packing 60*c* serve as the end interfacial space IS formed between an insulator forward-end surface 32*c* and the ground electrode counter surface 13*c*.

In the second modification of the second embodiment, similar to the first modification of the second embodiment described above, the insulator 30*c* is seated on the end-surface packing 60*c* at a position located forward of inlets 11*c* (specifically, the position of the insulator forward-end surface 32*c*). Also, the slits 62*c* of the end-surface packing 60*c* collectively serve as the end interfacial space IS formed between the insulator forward-end surface 32*c* and the ground electrode counter surface 13*c*. The end interfacial space IS communicates with the forward ring space RS1 and has a second outlet 19*c* which communicates with a space where the creepage gap GP is formed. Thus, as indicated by the arrows in FIG. 11(*a*), a portion of cooling fluid supplied to the forward ring space RS1 through the inlets 11*c* flows into the end interfacial space IS; is discharged, via the second outlet 19*c*, to the space where the creepage gap GP is formed; and subsequently, is discharged to the external space from a spark opening 18*c*. Since such a flow of cooling fluid cools the insulator forward-end surface 32*c* at all times, the insulator 30*c* is free from rapid cooling from a high-temperature condition and thus cracking thereof can be restrained. Also, since a forwardmost end portion (a portion encompassing the insulator forward-end surface 32*c*) of the insulator 30*c* assumes the form of a small-diameter portion 36*c*, an internal temperature difference of the insulator 30*c* can be mitigated, whereby cracking of the insulator 30*c* can be more reliably restrained.

Furthermore, in the second modification of the second embodiment, since the end-surface packing 60*c* also functions as the electrode plate 50, as compared with the case where the end-surface packing 60*c* and the electrode plate 50 are individually provided, the number of components can be reduced, and a deterioration in durability of the igniter plug can be restrained.

Third Modification of Second Embodiment

Figure 12A:
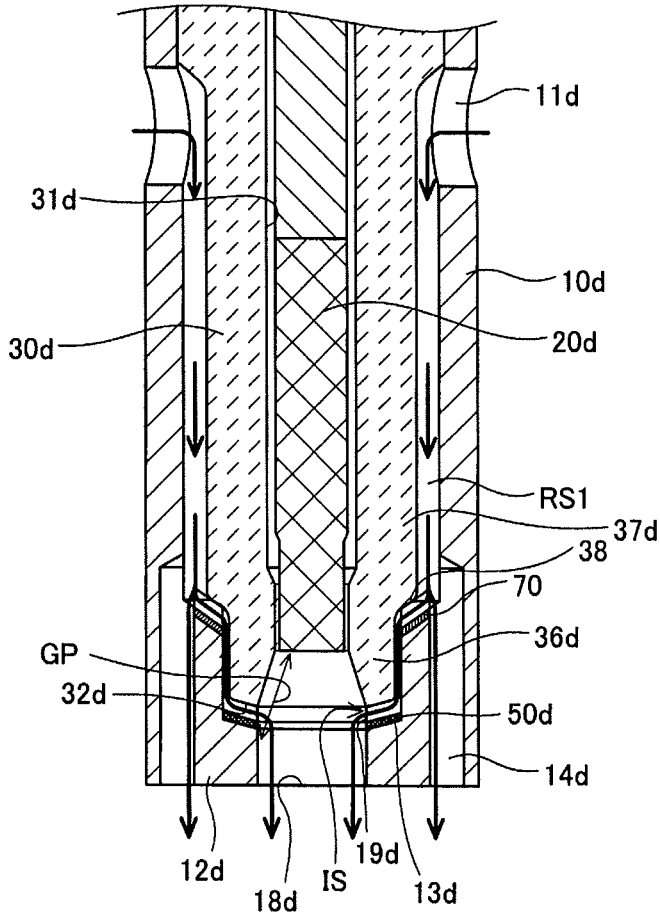
FIGS. 12(*a*), 12(*b*) and 12(*c*) are explanatory views schematically showing the configuration of a forward end portion of an igniter plug according to a third modification of the second embodiment.
Figure 12B:
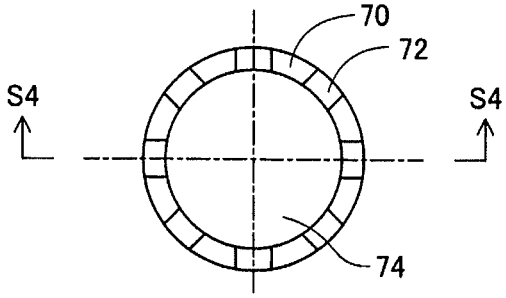
Figure 12C:
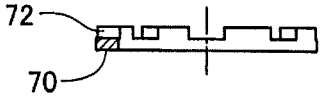

FIGS. 12(*a*), 12(*b*) and 12(*c*) are explanatory views schematically showing the configuration of a forward end portion of an igniter plug according to a third modification of the second embodiment. FIG. 12(*a*) shows the sectional configuration of a forward end portion of the igniter plug. FIG. 12(*b*) shows the planar configuration of a stepped-portion packing 70, which will be described later, as viewed from the rear side. FIG. 12(*c*) shows the side configuration (the right half of FIG. 12(*c*)) of the stepped-portion packing 70 and the sectional configuration (the left half of FIG. 12(*c*)) of the stepped-portion packing 70 taken along the line S4-S4 of FIG. 12(*b*).

The third modification of the second embodiment shown in FIG. 12 differs from the first modification of the second embodiment shown in FIG. 10 in a seating position where an insulator 30*d* is seated on a seat member, and other configurational features are similar to those of the first modification of the second embodiment. Specifically, in the third modification of the second embodiment, the seating position of the insulator 30*d* is the position of a boundary portion (hereinafter, called the "stepped portion 38") between a small-diameter portion 36*d* and a large-diameter portion 37*d*. In contrast to the first modification of the second embodiment in which the end-surface packing 60 is disposed on the electrode plate 50*d*, the stepped-portion packing 70, which serves as a seat member, is disposed on a surface of a ground electrode 10*d* (a ground electrode forward-end portion 12*d*) which faces the stepped portion 38.

As shown in FIGS. 12(*b*) and 12(*c*), the stepped-portion packing 70 is a substantially annular member having a center hole 74 and is formed from, for example, a nickel alloy which contains nickel as a main component. The stepped-portion packing 70 has slits 72 which are provided on its rear-side surface and radially extend between the center hole 74 and the outer circumference of the stepped-portion packing 70. The thickness of the stepped-portion packing 70 is adjusted such that, in a condition in which the insulator 30*d* is seated on the stepped-portion packing 70, the end interfacial space IS is formed between an insulator forward-end surface 32*d* and a ground electrode counter surface 13*d*. As in the case of the third modification of the second embodiment, when the flat electrode plate 50 is disposed on the ground electrode counter surface 13, the expression "the end interfacial space IS is formed between the insulator forward-end surface 32 and the ground electrode counter surface 13" is substantially synonymous with the expression "the end interfacial space IS is formed between the insulator forward-end surface 32 and the rear-side surface of the electrode plate 50."

In the third modification of the second embodiment, similar to the first modification of the second embodiment described above, the insulator 30*d* is seated on the stepped-portion packing 70 at a position located forward of inlets 11*d* (specifically, the position of the stepped portion 38 of the insulator 30*d*). Also, in a condition in which the insulator 30*d* is seated, the end interfacial space IS is formed between the insulator forward-end surface 32*d* and the ground electrode counter surface 13*d*. The end interfacial space IS communicates with the forward ring space RS1 via the slits 72 of the stepped-portion packing 70 and has a second outlet 19*d* which communicates with a space where the creepage gap GP is formed. Thus, as indicated by the arrows in FIG. 12(*a*), a portion of cooling fluid supplied to the forward ring space RS1 through the inlets 11*d* flows into the end interfacial space IS via the slits 72; is discharged, via the second outlet 19*d*, to the space where the creepage gap GP is formed; and subsequently, is discharged to the external space from a spark opening 18*d*. Since such a flow of cooling fluid cools the insulator forward-end surface 32*d* at all times, the insulator 30*d* is free from rapid cooling from a high-temperature condition and thus cracking thereof can be restrained. Also, since a forwardmost end portion (a portion encompassing the insulator forward-end surface 32*d*) of the insulator 30*d* assumes the form of the small-diameter portion 36*d*, an internal temperature difference of the insulator 30*d* can be mitigated, whereby cracking of the insulator 30*d* can be more reliably restrained.

Furthermore, in the third modification of the second embodiment, since the end interfacial space IS can be formed over substantially the entire insulator forward-end surface 32*d*, as compared with the case where only the slits 62 of the end-surface packing 60 collectively serve as the end interfacial space IS as in the case of the above-described first modification of the second embodiment, the end interfacial space IS can have a larger size, so that thermal shock on the insulator 30*d* can be more reliably reduced. Therefore, cracking of the insulator 30*d* can be more reliably restrained.

Fourth Modification of Second Embodiment

Figure 13A:
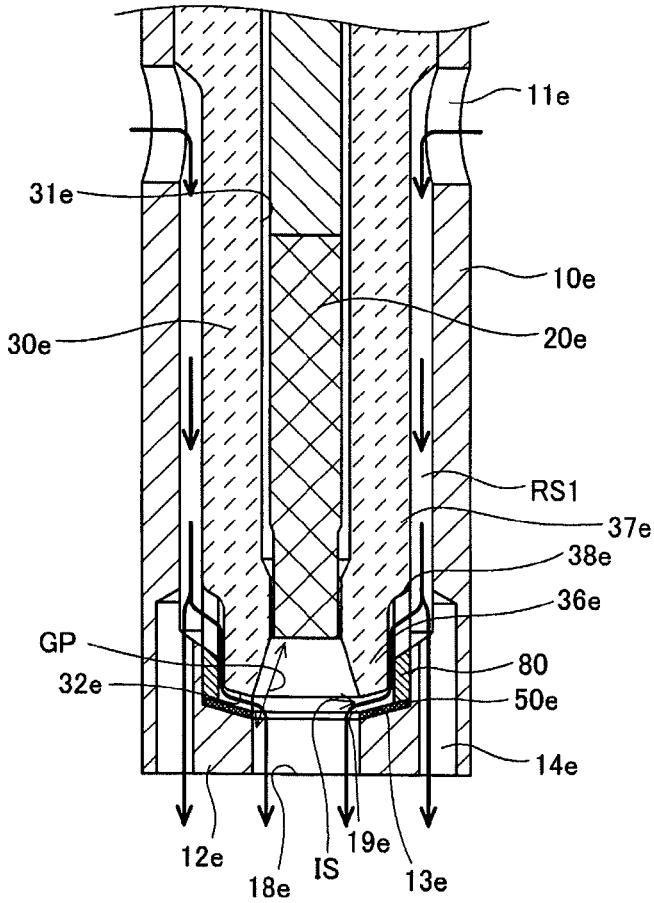
FIGS. 13(*a*), 13(*b*) and 13(*c*) are explanatory views schematically showing the configuration of a forward end portion of an igniter plug according to a fourth modification of the second embodiment.
Figure 13B:
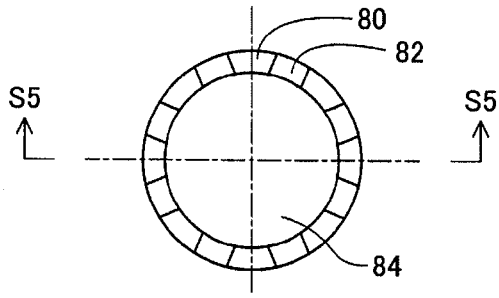
Figure 13C:
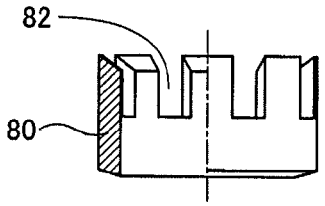

FIGS. 13(*a*), 13(*b*) and 13(*c*) are explanatory views schematically showing the configuration of a forward end portion of an igniter plug according to a fourth modification of the second embodiment. FIG. 13(*a*) shows the sectional configuration of a forward end portion of the igniter plug. FIG. 13(*b*) shows the planar configuration of a stepped-portion obturating-ring 80, which will be described later, as viewed from the rear side. FIG. 13(*c*) shows the side configuration (the right half of FIG. 13(*c*)) of the stepped-portion obturating-ring 80 and the sectional configuration (the left half of FIG. 13(*c*)) of the stepped-portion obturating-ring 80 taken along the line S5-S5 of FIG. 13(*b*).

The fourth modification of the second embodiment shown in FIG. 13 differs from the third modification of the second embodiment shown in FIG. 12 in a seat member used for allowing a insulator 30*e* to be seated thereon, and other configurational features are similar to those of the third modification of the second embodiment. Specifically, in the fourth modification of the second embodiment, while the seating position of the insulator 30*e* is, similar to the third modification of the second embodiment, the position of a stepped portion 38*e*, a seat member is the stepped-portion obturating-ring 80 disposed on an electrode plate 50*e* rather than the stepped-portion packing 70.

As shown in FIGS. 13(*b*) and 13(*c*), the stepped-portion obturating-ring 80 is a substantially annular member having a center hole 84 and is formed from, for example, a nickel alloy which contains nickel as a main component. The stepped-portion obturating-ring 80 has slits 82 which are provided on its rear-side surface. Slits 82 extend radially between the center hole 84 and the outer circumference of the stepped-portion obturating-ring 80. The thickness of the stepped-portion obturating-ring 80 is adjusted such that, in a condition in which the insulator 30*e* is seated on the stepped-portion obturating-ring 80, the end interfacial space IS is formed between an insulator forward-end surface 32*e* and a ground electrode counter surface 13*e*.

In the fourth modification of the second embodiment, similar to the third modification of the second embodiment described above, the insulator 30*e* is seated on the stepped-portion obturating-ring 80 at a position located forward of inlets 11*e* (specifically, the position of the stepped portion 38*e* of the insulator 30*e*). Also, in a condition in which the insulator 30*e* is seated, the end interfacial space IS is formed between the insulator forward-end surface 32*e* and the ground electrode counter surface 13*e*. The end interfacial space IS communicates with the forward ring space RS1 via the slits 82 of the stepped-portion obturating-ring 80 and has a second outlet 19*e* which communicates with a space where the creepage gap GP is formed. Thus, as indicated by the arrows in FIG. 13(*a*), a portion of cooling fluid supplied to the forward ring space RS1 through the inlets 11*e* flows into the end interfacial space IS via the slits 82; is discharged, via the second outlet 19*e*, to the space where the creepage gap GP is formed; and subsequently, is discharged to the external space from a spark opening 18*e*. Since such a flow of cooling fluid cools the insulator forward-end surface 32*e* at all times, the insulator 30*e* is free from rapid cooling from a high-temperature condition and thus cracking thereof can be restrained. Also, since a forwardmost end portion (a portion encompassing the insulator forward-end surface 32*e*) of the insulator 30*e* assumes the form of a small-diameter portion 36*e*, an internal temperature difference of the insulator 30*e* can be mitigated, whereby cracking of the insulator 30*e* can be more reliably restrained. Also, since the end interfacial space IS can be formed over substantially the entire insulator forward-end surface 32*e*, thermal shock on the insulator 30*e* can be more reliably reduced. Therefore, cracking of the insulator 30*e* can be more reliably restrained.

Furthermore, in the fourth modification of the second embodiment, since the stepped-portion obturating-ring 80, which serves as a seat member, is disposed on the electrode plate 50*e*, even though the insulator 30*e* is seated at the position of the stepped portion 38*e*, a reduction in the volume (area) of the electrode plate 50*e* can be restrained, whereby deterioration in durability can be restrained.

Fifth Modification of Second Embodiment

Figure 14A:
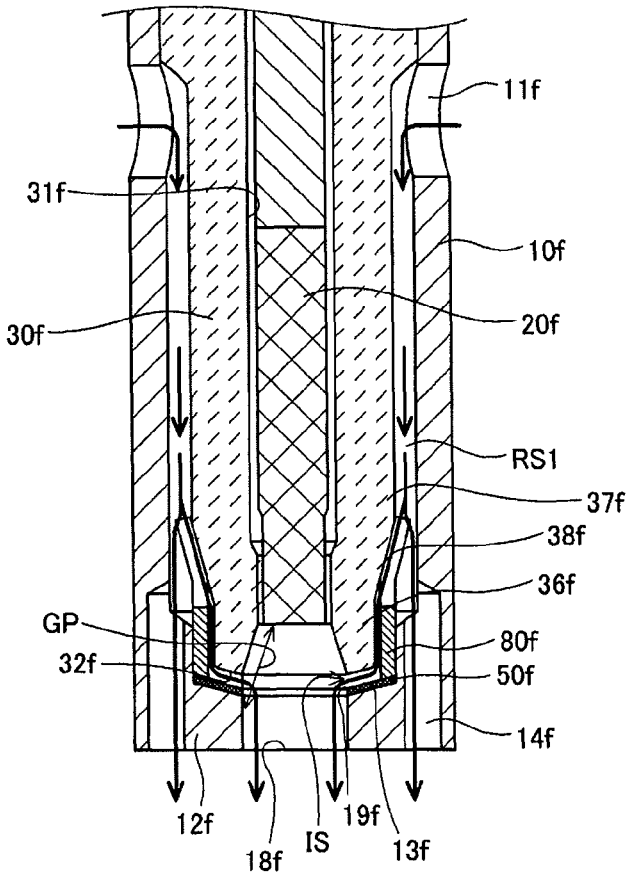
FIGS. 14(*a*), 14(*b*) and 14(*c*) are explanatory views schematically showing the configuration of a forward end portion of an igniter plug according to a fifth modification of the second embodiment.
Figure 14B:
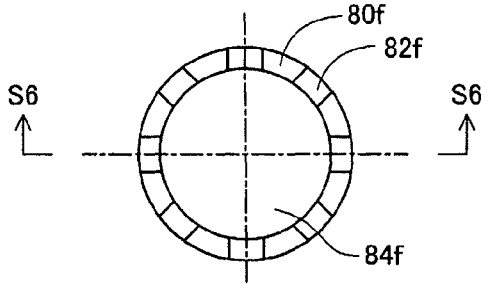
Figure 14C:
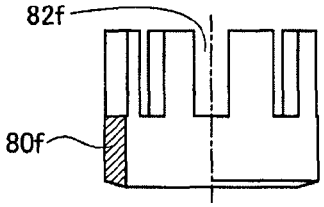

FIGS. 14(*a*), 14(*b*) and 14(*c*) are explanatory views schematically showing the configuration of a forward end portion of an igniter plug according to a fifth modification of the second embodiment. FIG. 14(*a*) shows the sectional configuration of a forward end portion of the igniter plug. FIG. 14(*b*) shows the planar configuration of a stepped-portion obturating-ring 80*f* as viewed from the rear side. FIG. 14(*c*) shows the side configuration (the right half of FIG. 14(*c*)) of the stepped-portion obturating-ring 80*f* and the sectional configuration (the left half of FIG. 14(*c*)) of the stepped-portion obturating-ring 80*f* taken along the line S6-S6 of FIG. 14(*b*).

The fifth modification of the second embodiment shown in FIG. 14 differs from the fourth modification of the second embodiment shown in FIG. 13 in the configuration of a stepped portion 38*f* of an insulator 30*f* and the configuration of the stepped-portion obturating-ring 80*f*, and other configurational features are similar to those of the fourth modification of the second embodiment. Specifically, in the fifth modification of the second embodiment, the outer circumferential surface of the stepped portion 38*f* of the insulator 30*f* forms an angle of 45 degrees or less with respect to the axis OL. Also, as viewed on a section which contains the axis OL, the stepped-portion obturating-ring 80*f*, which serves as a seat member for allowing the insulator 30*f* to be seated thereon at the position of the stepped portion 38*f*, is in line contact with the outer circumferential surface of the stepped portion 38*f*. Such a configuration can be implemented as follows: after the stepped-portion obturating-ring 80*f* is inserted into a bore of the ground electrode 10*f*, the insulator 30*f* is inserted so as to press, by the outer circumferential surface of the stepped portion 38*f* of the insulator 30*f*, a rear end portion (a portion where the slits 82*f* are formed) of the stepped-portion obturating-ring 80*f*, thereby buckling, i.e., deforming, the rear end portion of the stepped-portion obturating-ring 80*f* radially outward. The angle of the outer circumferential surface of the stepped portion 38*f* of the insulator 30*f* and the shape of the stepped-portion obturating-ring 80*f* are adjusted such that, in a condition in which the stepped-portion obturating-rind 80*f* is buckled by means of the insulator 30*f*, the end interfacial space IS is formed between an insulator forward-end surface 32*f* and a ground electrode counter surface 13*f*.

In the fifth modification of the second embodiment, similar to the fourth modification of the second embodiment described above, the insulator 30*f* is seated on the stepped-portion obturating-ring 80*f* at a position located forward of inlets 11*f* (specifically, the position of the stepped portion 38*f* of the insulator 30*f*). Also, in a condition in which the insulator 30*f* is seated, the end interfacial space IS is formed between the insulator forward-end surface 32*f* and the ground electrode counter surface 13*f*. The end interfacial space IS communicates with the forward ring space RS1 via the slits 82*f* of the stepped-portion obturating-ring 80*f* and has a second outlet 19*f* which communicates with a space where the creepage gap GP is formed. Thus, as indicated by the arrows in FIG. 14(*a*), a portion of cooling fluid supplied to the forward ring space RS1 through the inlets 11*f* flows into the end interfacial space IS via the slits 82*f*; is discharged, via the second outlet 19*f*, to the space where the creepage gap GP is formed; and subsequently, is discharged to the external space from a spark opening 18*f*. Since such a flow of cooling fluid cools the insulator forward-end surface 32*f* at all times, the insulator 30*f* is free from rapid cooling from a high-temperature condition and thus cracking thereof can be restrained. Also, since a forwardmost end portion (a portion encompassing the insulator forward-end surface 32*f*) of the insulator 30*f* assumes the form of a small-diameter portion 36*f*, an internal temperature difference of the insulator 30*f* can be mitigated, whereby cracking of the insulator 30*f* can be more reliably restrained. Also, since the end interfacial space IS can be formed over substantially the entire insulator forward-end surface 32*f*, thermal shock on the insulator 30*f* can be more reliably reduced. Therefore, cracking of the insulator 30*f* can be more reliably restrained. Also, since the stepped-portion obturating-ring 80*f*, which serves as a seat member, is disposed on an electrode plate 50*f*, even though the insulator 30*f* is seated at the position of the stepped portion 38*f*, a reduction in the volume (area) of the electrode plate 50*f* can be restrained, whereby deterioration in durability can be restrained.

Furthermore, in the fifth modification of the second embodiment, since dimensional variations of the insulator 30*f* along the direction of the axis OL can be absorbed by deformation of the stepped-portion obturating-ring 80*f*, the dimensional accuracy of the igniter plug can be improved without need to prepare various stepped-portion obturating-rings 80 of different dimensions and to select a stepped-portion obturating-ring 80 having an appropriate thickness.

C. Modifications

The present invention is not limited to the above-described embodiments or modes, but may be embodied in various other forms without departing from the gist of the invention. For example, the following modifications are possible.

C1. Modification 1

Figure 15:
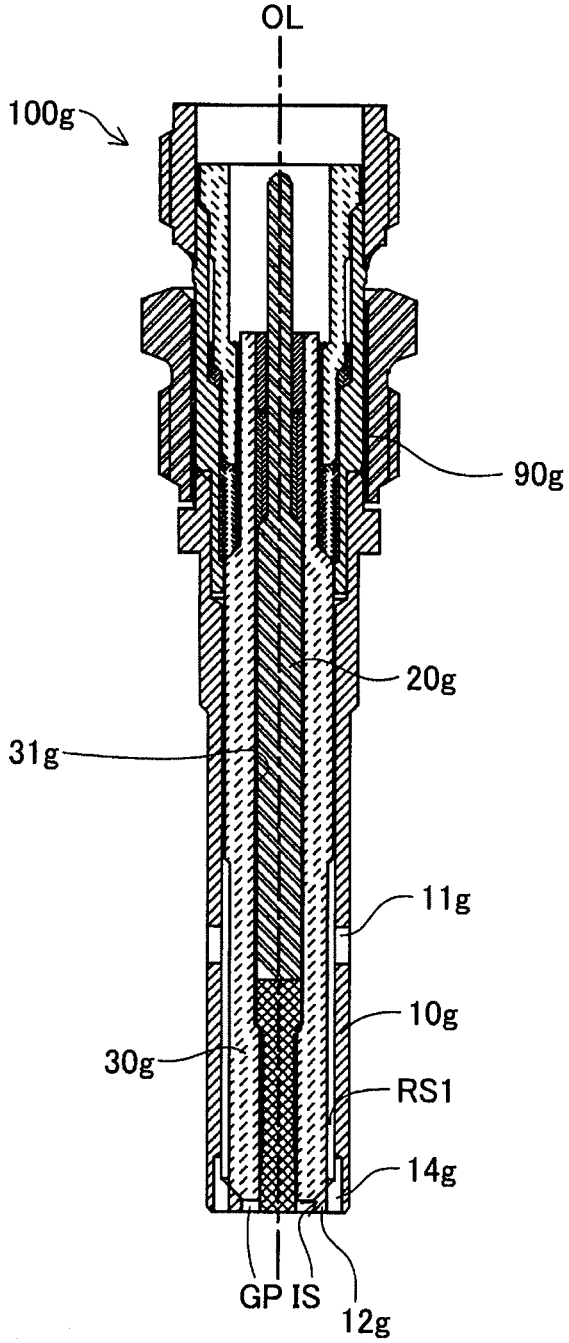
FIG. 15 is an explanatory view schematically showing the configuration of an igniter plug 100*g* according to a modification of the present invention.

The igniter plug 100 of the above embodiments is a so-called lead-in surface type igniter plug. However, the present invention can be applied to igniter plugs of other types. FIG. 15 is an explanatory view schematically showing the configuration of an igniter plug 100*g* according to a modification of the present invention. The modified igniter plug 100*g* shown in FIG. 15 is a so-called full surface type igniter plug. Even in the modified igniter plug 100*g*, the end interfacial space IS is formed between the forward end surface of an insulator 30*g* and a surface of a ground electrode 10*g* which faces the forward end surface of the insulator 30*g*. Thus, even in the modified igniter plug 100*g* shown in FIG. 15, a portion of cooling fluid supplied to the forward ring space RS1 through inlets 11*g* flows into the end interfacial space IS and is discharged to a space where the creepage gap GP is formed. Since such a flow of cooling fluid cools the forward end surface of the insulator 30*g* at all times, the insulator 30*g* is free from rapid cooling from a high-temperature condition and thus cracking thereof can be restrained.

C2. Modification 2

The configurations of the igniter plug 100 and the fixation methods for the insulator 30 in the above embodiments are mere examples and can be modified in various ways. For example, in the first embodiment described above, the electrode plate 50 is not disposed on the ground electrode forward-end portion 12. However, even in the first embodiment, similar to the second embodiment, the electrode plate 50 may be disposed on the ground electrode forward-end portion 12. Also, in fixation of the insulator 30 to the ground electrode 10, the filler powder 45 is not necessarily heated. Also, the method of fixing the insulator 30 and the ground electrode 10 to each other is not limited to those appearing in the above description of the embodiments. Other fixation methods, such as a welding process, a glass seal process, and a brazing process, may be employed. Also, in the above embodiments, the insulator forward-end surface 32, the ground electrode counter surface 13, and the outer circumferential surface of the stepped portion 38 are not perpendicular to the axis OL. However, these surfaces may be perpendicular to the axis OL.

C3. Modification 3

Among the constituent elements in the above-described modes, embodiments, and modifications, constituent elements other than those claimed in an independent claim are additional ones and can be eliminated or combined as appropriate.

Having described the invention, the following is claimed:

1. An igniter plug comprising:

a center electrode, an insulator having an axial bore extending in an axial direction and accommodating the center electrode therein, and a ground electrode accommodating the insulator therein in such a manner as to form a first space between the ground electrode and at least a portion of an outer circumferential surface of the insulator, wherein the ground electrode has a ground electrode forward-end portion which forms a gap in cooperation with the center electrode;

with a side toward the gap being taken as a forward side along the axial direction, the ground electrode has an inlet for supplying cooling fluid therethrough to the first space, and a first outlet located forward of the inlet and radially outward of an inner circumference of the ground electrode forward-end portion and adapted to discharge the cooling fluid therethrough; and a second space communicating with the first space and having a second outlet for discharging the cooling fluid therethrough is formed between an insulator end surface, which is a forward end surface of the insulator, and a ground electrode counter surface, which is a surface of the ground electrode which faces the insulator end surface.

2. An igniter plug according to claim 1, further comprising a seat member sandwiched in the axial direction between the insulator and the ground electrode and adapted to restrict a forward movement of the insulator relative to the ground electrode at a predetermined seating position located forward of the inlet, wherein the seat member has a slit extending in a radial direction at the seating position.

3. An igniter plug according to claim 2, wherein the seating position is a position of the insulator end surface, and the seat member is formed from a metal having a melting point equal to or higher than that of the ground electrode.

4. An igniter plug according to claim 2, wherein the insulator has a first portion which encompasses the insulator end surface, and a second portion greater in diameter than the first portion, and the seating position is a position of a stepped portion which is a boundary between the first portion and the second portion.

5. An igniter plug according to claim 4, wherein an outer circumferential surface of the stepped portion forms an angle of 45 degrees or less with respect to the axial direction, and as viewed on a section which contains an axis of the igniter plug, the seat member at the seating position is in line contact with the outer circumferential surface of the stepped portion.

6. An igniter plug according to any one of claims 2 to 5, further comprising an electrode plate formed from a material having a melting point equal to or higher than that of the ground electrode, and disposed on the ground electrode counter surface, wherein the seat member is disposed on the electrode plate.

7. An igniter plug according to claim 1, wherein the second space has a dimension of 0.25 mm or less as measured along the axial direction.

8. An igniter plug according to claim 7, wherein the second space has a dimension of 0.15 mm or less as measured along the axial direction.

9. A method of manufacturing an igniter plug having:

a center electrode, an insulator having an axial bore extending in an axial direction and accommodating the center electrode therein, and a ground electrode accommodating the insulator therein in such a manner as to form a first space between the ground electrode and at least a portion of an outer circumferential surface of the insulator, wherein the ground electrode has a ground electrode forward-end portion which forms a gap in cooperation with the center electrode;

with a side toward the gap being taken as a forward side along the axial direction, the ground electrode has an inlet for supplying cooling fluid therethrough to the first space, and a first outlet located forward of the inlet and radially outward of an inner circumference of the ground electrode forward-end portion and adapted to discharge the cooling fluid therethrough;

a second space communicating with the first space and having a second outlet for discharging the cooling fluid therethrough is formed between an insulator end surface, which is a forward end surface of the insulator, and a ground electrode counter surface, which is a surface of the ground electrode which faces the insulator end surface comprising:

a step of fixing the insulator and the ground electrode together through utilization of a filler powder and crimping, wherein the fixing step includes a step of heating the filler powder.

10. A method of manufacturing an igniter plug having:

a center electrode, an insulator having an axial bore extending in an axial direction and accommodating the center electrode therein, and a ground electrode accommodating the insulator therein in such a manner as to form a first space between the ground electrode and at least a portion of an outer circumferential surface of the insulator, wherein the ground electrode has a ground electrode forward-end portion which forms a gap in cooperation with the center electrode;

with a side toward the gap being taken as a forward side along the axial direction, the ground electrode has an inlet for supplying cooling fluid therethrough to the first space, and a first outlet located forward of the inlet and radially outward of an inner circumference of the ground electrode forward-end portion and adapted to discharge the cooling fluid therethrough; and a second space communicating with the first space and having a second outlet for discharging the cooling fluid therethrough is formed between an insulator end surface, which is a forward end surface of the insulator, and a ground electrode counter surface, which is a surface of the ground electrode which faces the insulator end surface comprising the steps of:

disposing a flammable packing on the ground electrode counter surface of the ground electrode;

inserting the insulator into the ground electrode until the insulator end surface comes into contact with a surface of the flammable packing; and burning off the flammable packing so as to convert a space occupied by the flammable packing into the second space.

* * * * *